US007708609B2

(12) United States Patent
Plante et al.

(10) Patent No.: US 7,708,609 B2
(45) Date of Patent: May 4, 2010

(54) WATERCRAFT REVERSE GATE OPERATION

(75) Inventors: Renald Plante, Rock Forest (CA); Andre Denis, Sherbrooke (CA); Dominic Dagenais, Canton de Shefford (CA)

(73) Assignee: Bombardier Recreational Products Inc., Valcourt (CA)

( * ) Notice: Subject to any disclaimer, the term of this patent is extended or adjusted under 35 U.S.C. 154(b) by 63 days.

(21) Appl. No.: 11/961,650

(22) Filed: Dec. 20, 2007

(65) Prior Publication Data

US 2009/0275248 A1 Nov. 5, 2009

Related U.S. Application Data

(60) Provisional application No. 60/871,698, filed on Dec. 22, 2006.

(51) Int. Cl.

| | |
|---|---|
| ***B63H 11/11*** | (2006.01) |
| *B63H 21/22* | (2006.01) |
| *B63H 23/00* | (2006.01) |
| *B63H 11/00* | (2006.01) |
| *B63H 11/107* | (2006.01) |

(52) U.S. Cl. ..... 440/41; 440/1; 440/38; 440/40

(58) Field of Classification Search ..... 440/38–41, 440/1

See application file for complete search history.

(56) References Cited

U.S. PATENT DOCUMENTS 5,474,007 A 12/1995 Kobayashi (Continued)

FOREIGN PATENT DOCUMENTS

WO WO/2008-025169 A1 3/2008

*Primary Examiner*—Daniel V Venne
(74) *Attorney, Agent, or Firm*—Osler, Hoskin & Harcourt LLP

(57) ABSTRACT

A method of controlling a watercraft comprises actuating a lever, controlling a speed of rotation of an engine to be at or below a reverse gate actuation speed in response to the actuation of the lever, moving the reverse gate in response to the actuation of the lever without further driver intervention once the speed of rotation of the engine is at or below the reverse gate actuation speed, and controlling the speed of rotation of the engine in order to decelerate the watercraft in response to the actuation of the lever and the reverse gate moving without further driver intervention. A watercraft and a method of controlling the watercraft based at least in part on an angle of a helm assembly are also disclosed.

17 Claims, 11 Drawing Sheets

U.S. PATENT DOCUMENTS 5,494,464 A 2/1996 Kobayashi et al.
5,507,672 A 4/1996 Imaeda
5,752,864 A 5/1998 Jones et al.
5,755,601 A * 5/1998 Jones ..... 440/1
6,045,418 A 4/2000 Roos
6,113,443 A 9/2000 Eichinger
6,146,219 A * 11/2000 Blanchard ..... 440/40
6,234,100 B1 5/2001 Fadeley et al.
6,401,644 B2 6/2002 Fadeley et al.
6,453,835 B2 9/2002 Fadeley et al.
6,533,623 B2 3/2003 Simard et al.
6,547,611 B1 4/2003 Boroos et al.
6,676,462 B2 1/2004 Yanagihara
6,722,632 B2 4/2004 Kenny et al.
6,743,062 B1 6/2004 Jones
6,875,065 B2 4/2005 Tsuchiya et al.
6,905,378 B2 6/2005 Uraki et al.
7,163,425 B2 * 1/2007 Kamio ..... 440/1
7,195,527 B2 3/2007 Tani et al.
7,481,688 B2 * 1/2009 Kobayashi ..... 440/53
2003/0077954 A1 4/2003 Fadeley et al.
2008/0133075 A1 6/2008 St-Pierre et al.
2008/0182463 A1 7/2008 St-Pierre et al.
2008/0233811 A1 9/2008 St-Pierre et al.

* cited by examiner

WATERCRAFT REVERSE GATE OPERATION

CROSS-REFERENCE

The present application claims priority to U.S. Provisional Patent Application No. 60/871,698 filed on Dec. 22, 2006, the entirety of which is incorporated herein by reference.

FIELD OF THE INVENTION

The present invention relates to watercraft having a reverse gate and methods of operating the reverse gate.

BACKGROUND OF THE INVENTION

In jet propelled watercraft, such as personal watercraft or jet boat, the watercraft can be propelled in reverse by lowering a reverse gate behind the output of the water jet thus redirecting the jet toward the front of the watercraft which creates a thrust in the reverse direction. The reverse gate is actuated by a hand activated lever which, when pulled, lowers the reverse gate in front of the water jet. The lever is placed near the driver's area but the driver must let go of the steering mechanism in order the grasp the reverse lever. Therefore, the driver must drive with only one hand on the steering mechanism while actuating the lever. Also, in some cases they must momentarily divert their attention when reaching for the reverse lever. On some watercraft, the reverse lever is on the same side of the watercraft as the throttle operator which forces the driver to release the throttle operator to activate the reverse gate lever.

In most jet propelled watercraft, the engine and jet propulsion system are connected directly to each other via at least one shaft. This arrangement causes the jet propulsion system to always provide some forward thrust, even when the engine is idling, because the shaft is still rotating. This results in the watercraft moving forward even though the driver is not actuating the throttle lever. One possible solution consists in providing a clutch between the engine and the jet propulsion system, however this can prove to be mechanically complex in view of the limited area available in the engine compartment of these vehicles.

Also, as in most watercraft, jet propelled watercraft are not usually provided with means for actively decelerating the watercraft. The driver must therefore plan ahead of time to decelerate, and eventually stop, the watercraft as they need to do so by letting the vehicle decelerate on its own.

Therefore, there is a need for a way to activate the reverse gate of a jet propelled watercraft which allows the driver of the vehicle to keep both hands on the steering mechanism.

There is also a need for a way to decelerate a jet propelled watercraft.

SUMMARY OF THE INVENTION

It is an object of the present invention to ameliorate at least some of the inconveniences present in the prior art.

It is also an object of the present invention to provide a jet propelled watercraft having a lever which when actuated causes a reverse gate to move from a first stowed position to a second position without further driver intervention and controls a speed of rotation of the engine in order to decelerate the watercraft without further driver intervention.

It is also an object of the present invention to provide a method of controlling a jet propelled watercraft where actuating a lever causes a reverse gate to move from a first stowed position to a second position without further driver intervention and controls a speed of rotation of the engine in order to decelerate the watercraft without further driver intervention.

It is also an object of the present invention to provide a method of controlling a jet propelled watercraft where turning a helm assembly when a speed of rotation of the engine is below a steering assist speed causes a reverse gate to move from a first stowed position to a second position without further driver intervention and then controls a speed of rotation of the engine in order to decelerate the watercraft without further driver intervention.

In one aspect, the invention provides a method of controlling a watercraft. The watercraft has a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a lever, and a reverse gate operatively connected to the hull, the reverse gate being movable between a first stowed position and a second position in which the reverse gate redirects a jet of water expelled from the jet propulsion system, the reverse gate being in operative connection with the lever. The method comprises actuating the lever, controlling a speed of rotation of the engine to be at or below a reverse gate actuation speed in response to the actuation of the lever, moving the reverse gate to the second position in response to the actuation of the lever without further driver intervention once the speed of rotation of the engine is at or below the reverse gate actuation speed, and controlling the speed of rotation of the engine in order to decelerate the watercraft in response to the actuation of the lever and the reverse gate moving to the second position without further driver intervention.

In an additional aspect, controlling a speed of rotation of the engine in order to decelerate the watercraft includes increasing the speed of rotation of the engine above the reverse gate actuation speed.

In a further aspect, the method further comprises adjusting the second position of the reverse gate without further driver intervention.

In an additional aspect, controlling the speed of rotation of the engine comprises adjusting a position of a throttle valve of the engine.

In a further aspect, controlling the speed of rotation of the engine comprises adjusting at least one of an ignition timing and an injection timing of the engine.

In an additional aspect, the method further comprises sensing a position of the throttle operator, adjusting a position of a throttle valve of the engine based on the position of the throttle operator when the lever is not actuated, generating a signal when the lever is actuated, and adjusting the position of the throttle valve of the engine based on the signal when the lever is actuated.

In a further aspect, the method further comprises sensing a speed of the watercraft, and moving the reverse gate to a neutral position in which the reverse gate redirects a jet of water expelled from the jet propulsion system so as to maintain the watercraft in position when the speed of the watercraft is near or at zero without further driver intervention.

In another aspect, the invention provides a watercraft having a hull and a deck is disposed on the hull. An engine compartment is defined between the hull and the deck. An engine is disposed in the engine compartment. A throttle body has a throttle valve and is in fluid communication with the engine. A jet propulsion system is connected to the hull and is operatively connected to the engine. An electronic control unit (ECU) is associated with the watercraft for controlling at least an operation of the engine. A throttle operator is movable between an idle position and an actuated position and is in electronic communication with the ECU. A throttle valve actuator is operatively connected to the throttle valve and is in electronic communication with the ECU. An engine speed sensor senses a rotational speed of the engine and is in electronic communication with the ECU. A reverse gate is operatively connected to the hull. The reverse gate is movable between a first stowed position and a second position in which the reverse gate redirects a jet of water expelled from the jet propulsion system. A reverse gate actuator is operatively connected to the reverse gate for moving the reverse gate between the first stowed position and the second position, and is in electronic communication with the ECU. A lever is associated with the watercraft and is in electronic communication with the ECU. The ECU sends a first signal to the throttle valve actuator in response to the actuation of the lever such that a speed of rotation of the engine is controlled to be at or below a reverse gate actuation speed. The ECU sends a second signal to the reverse gate actuator to move the reverse gate to the second position in response an actuation of the lever once the speed of rotation of the engine is at or below the reverse gate actuation speed. The ECU sends a third signal to the throttle valve actuator in response to the actuation of the lever such that actuating the lever results in a controlled deceleration of the watercraft once the reverse gate is in the second position.

In an additional aspect, the watercraft also has a handlebar. The throttle operator is disposed on the handlebar. The throttle operator is selected from a group consisting of a thumb-actuated throttle lever, a finger-actuated throttle lever, and a twist grip.

In a further aspect, the reverse gate actuator is an electric actuator.

In an additional aspect, the reverse gate actuator is a hydraulic actuator.

In a further aspect, the controlled deceleration is proportional to a degree of actuation of the lever.

In an additional aspect, the watercraft also has a watercraft speed sensor for sensing the speed of the watercraft and being in electronic communication with the ECU.

In another aspect, the invention provides a method of controlling a watercraft. The watercraft has a hull, a deck disposed on the hull, a seat disposed on the deck, a helm assembly disposed on the deck, an engine compartment defined between the hull and the deck, an engine disposed in the engine compartment, an electronic control unit, a jet propulsion system connected to the hull and operatively connected to the engine, a throttle operator for controlling the engine, and a reverse gate operatively connected to the hull, the reverse gate being movable between a first stowed position and a second position in which the reverse gate redirects a jet of water expelled from the jet propulsion system, the reverse gate being in operative connection with the lever. The method comprises turning the helm assembly beyond a predetermined angle, determining if a speed of rotation of the engine is below a steering assist speed, controlling the speed of rotation of the engine to be at or below a reverse gate actuation speed in response to the helm assembly being turned beyond the predetermined angle and the speed of rotation of the engine being below the steering assist speed, moving the reverse gate to the second position in response to the helm assembly being turned beyond the predetermined angle without further driver intervention once the speed of rotation of the engine is at or below the reverse gate actuation speed, and controlling the speed of rotation of the engine in order to decelerate the watercraft in response to helm assembly being turned beyond the predetermined angle and the reverse gate moving to the second position without further driver intervention.

In an additional aspect, controlling a speed of rotation of the engine in order to decelerate the watercraft includes increasing the speed of rotation of the engine above the reverse gate actuation speed.

In a further aspect, controlling the speed of rotation of the engine comprises adjusting a position of a throttle valve of the engine.

In an additional aspect, controlling the speed of rotation of the engine comprises adjusting at least one of an ignition timing and an injection timing of the engine.

For purposes of this application, the terms "without further driver intervention" mean that once a driver has done a first action, the remaining action(s) occur(s) as a result of that first action and do not require any additional actions on the part of the driver in order to occur. For example, in one of the embodiments described herein, once the driver moves the throttle operator to an idle position, the reverse gate of the watercraft moves from a first stowed position to a second position without the driver having to do anything more than moving the throttle operator, and therefore the reverse gate moves without further driver intervention. It should be understood that "without further driver intervention" does not exclude the possibility that the driver could intervene, but rather that it means that should the driver not intervene, the remaining action(s) will nonetheless occur as a result of a first action being performed by the driver. It should also be understood that actions which occur "without further driver intervention" could only do so under some circumstances and may require driver intervention in other circumstances.

Also, for purposes of this application, the terms "controlled deceleration" mean a gradual reduction in speed compared to an uncontrolled deceleration which may result in an abrupt reduction in speed which could cause the driver of the watercraft to lose control of the watercraft.

Embodiments of the present invention each have at least one of the above-mentioned objects and/or aspects, but do not necessarily have all of them. It should be understood that some aspect of the present invention that have resulted from attempting to attain the above-mentioned objects may not satisfy these objects and/or may satisfy other objects not specifically recited herein.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The general construction of a personal watercraft 10 in accordance with this invention is shown in FIGS. 1-5. The following description relates to one way of manufacturing a personal watercraft. Obviously, those of ordinary skill in the watercraft art will recognize that there are other known ways of manufacturing and designing watercraft and that this invention would encompass these other known ways and designs.

Figure 1:
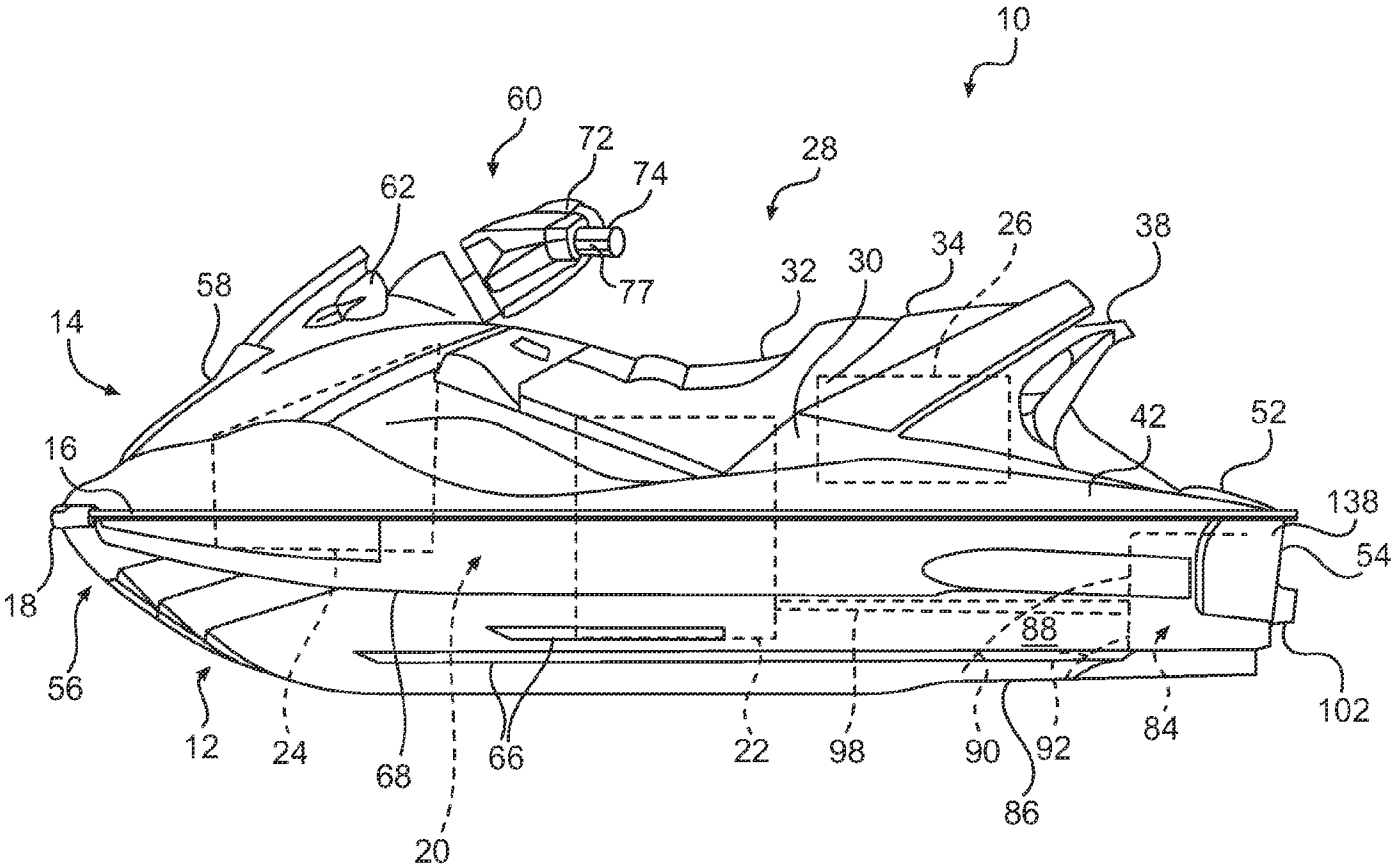
FIG. 1 illustrates a side view of a personal watercraft in accordance with the invention.

The watercraft 10 of FIG. 1 is made of a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion or all of the seam 16.

The space between the hull 12 and the deck 14 forms a volume commonly referred to as the engine compartment 20 (shown in phantom). The engine compartment 20 accommodates an engine 22, as well as a muffler, tuning pipe, gas tank, electrical system (battery, electronic control unit, etc.), air box, storage bins 24, 26, and other elements required or desirable in the watercraft 10.

Figure 2:
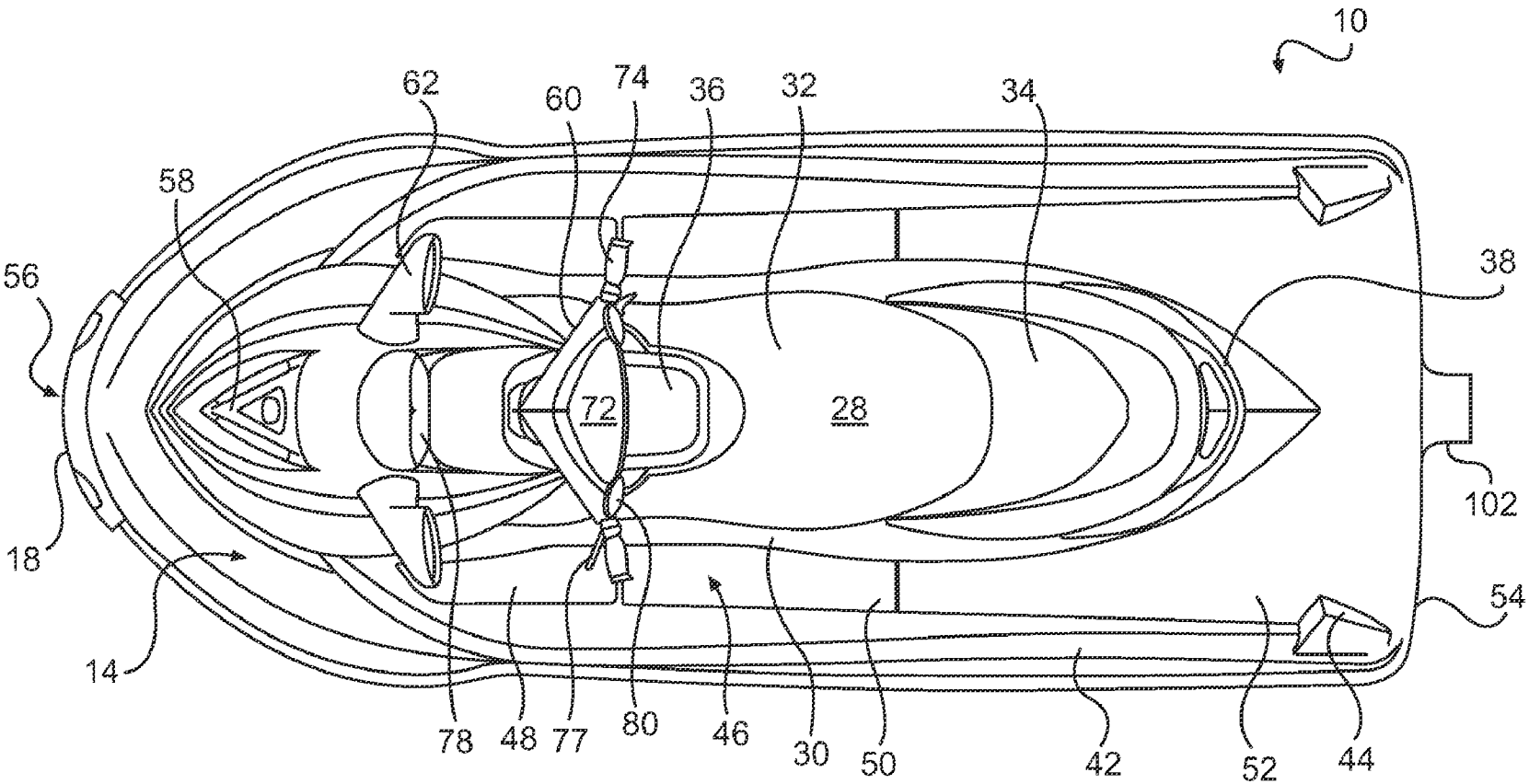
FIG. 2 is a top view of the watercraft of FIG. 1.

As seen in FIGS. 1 and 2, the deck 14 has a centrally positioned straddle-type seat 28 positioned on top of a pedestal 30 to accommodate multiple riders in a straddling position. As seen in FIG. 2, the seat 28 includes a first, front seat portion 32 and a rear, raised seat portion 34. The seat 28 is preferably made as a cushioned or padded unit, or as interfitting units. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. Seat portion 32 covers an engine access opening defined by a top portion of the pedestal 30 to provide access to the engine 22 (FIG. 1). Seat portion 34 covers a removable storage box 26 (FIG. 1). A "glove compartment" or small storage box 36 is provided in front of the seat 28.

Figure 4:
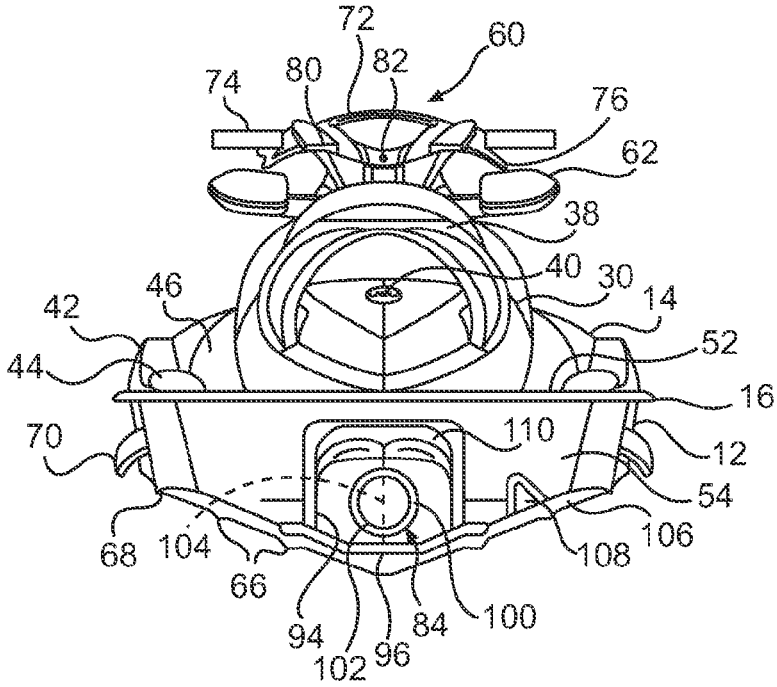
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4, the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. A passenger riding the watercraft 10 facing towards the rear, to spot a water-skier for example, may place his or her heels on the heel rests 44, thereby providing a more stable riding position. Heel rests 44 could also be formed separately from the gunnels 42.

Located on both sides of the watercraft 10, between the pedestal 30 and the gunnels 42 are the footrests 46. The footrests 46 are designed to accommodate the riders' feet in various riding positions. To this effect, the footrests 46 each have a forward portion 48 angled such that the front portion of the forward portion 48 (toward the bow of the watercraft 10) is higher than the rear portion of the forward portion 48. The remaining portions of the footrests 46 are generally horizontal. Of course, any contour conducive to a comfortable rest for the riders could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water onto the reboarding platform 52.

Figure 3:
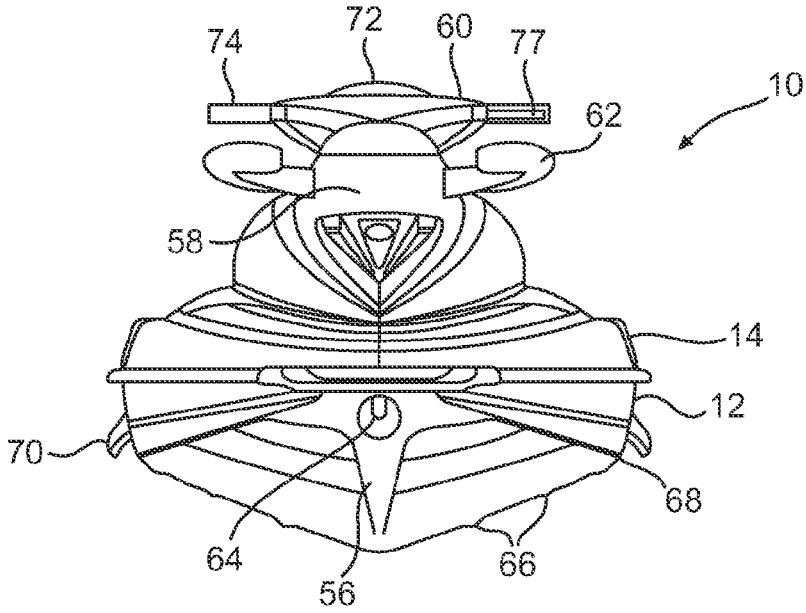
FIG. 3 is a front view of the watercraft of FIG. 1.

Referring to the bow 56 of the watercraft 10, as seen in FIGS. 2 and 3, the watercraft 10 is provided with a hood 58 located forwardly of the seat 28 and a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft 10 on a trailer, for instance.

Figure 5:
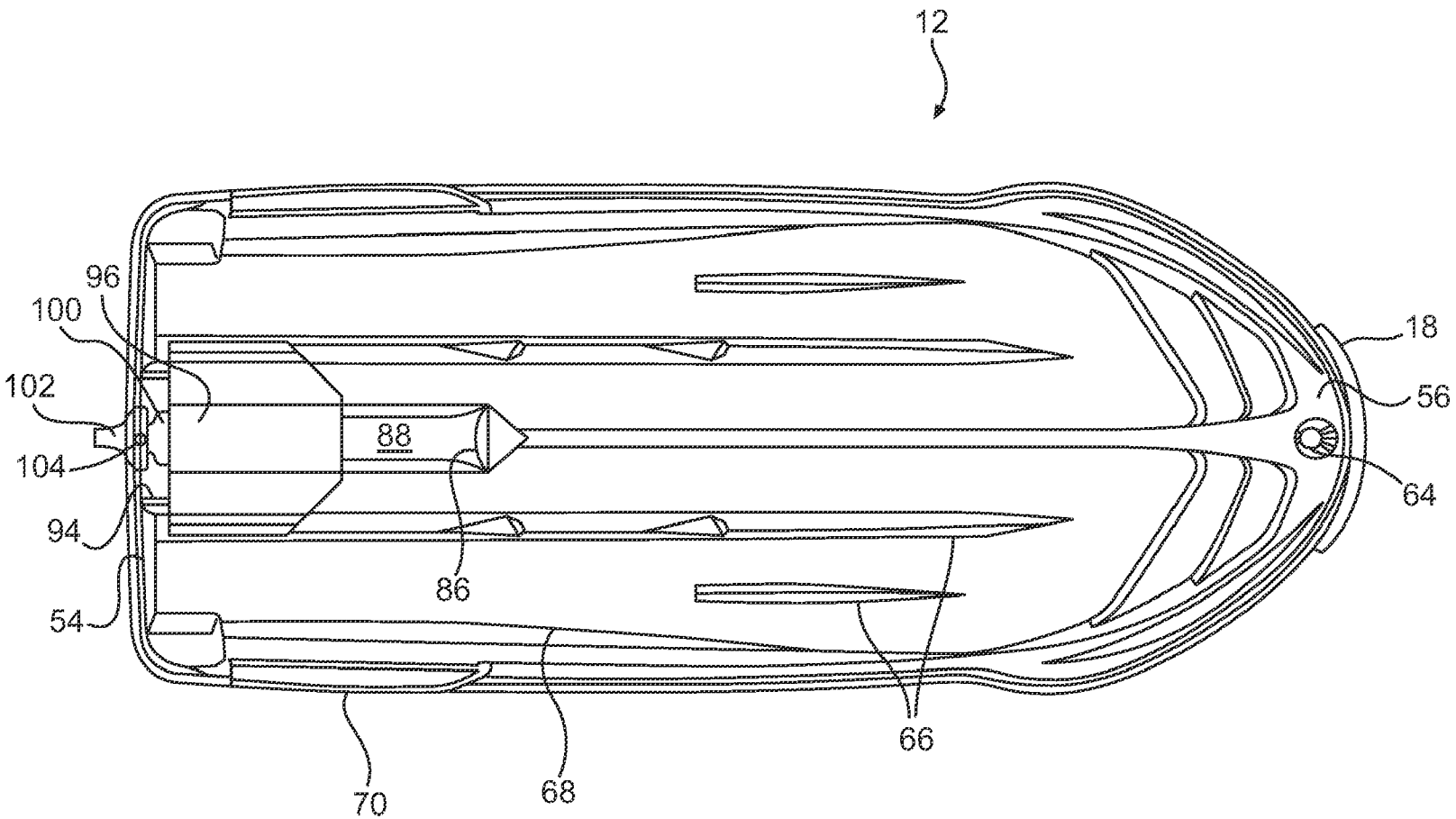
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 with respect to the hull 12 may be adjustable to change the handling characteristics of the watercraft 10 and accommodate different riding conditions. Trim tabs, which are commonly known, may also be provided at the transom and may be controlled from the helm 60.

As best seen in FIGS. 3 and 4, the helm assembly 60 is positioned forwardly of the seat 28. The helm assembly 60 has a central helm portion 72, that is padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. In a preferred embodiment, the throttle operator 76 is biased towards the idle position, such that, should the driver of the watercraft 10 let go of the throttle operator 76, it will move to the idle position. The other of the steering handles 74 is provided with a lever 77 used by the driver to decelerate the watercraft 10 as described in greater detail below.

As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 has various buttons 80, which could alternatively be in the form of levers or switches, that allow the driver to modify the display data or mode (speed, engine rpm, time . . . ) on the display cluster 78 or to change a condition of the watercraft 10, such as trim (the pitch of the watercraft 10).

The helm assembly 60 is provided with a key receiving post 82 located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. As is known, the jet propulsion system 84 pressurizes water to create thrust. The water is first scooped from under the hull 12 through an inlet 86, which has an inlet grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters a jet pump (not shown). The jet pump is located in a formation in the hull 12, referred to as the tunnel 94. The tunnel 94 is defined at the front, sides, and top by the hull 12 and is open at the transom 54. The bottom of the tunnel 94 is closed by the ride plate 96. The ride plate 96 creates a surface on which the watercraft 10 rides or planes at high speeds.

The jet pump includes an impeller (not shown) and a stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump, it goes through a venturi 100. Since the venturi's exit diameter is smaller than its entrance diameter, the water is accelerated further, thereby providing more thrust. A steering nozzle 102 is pivotally attached to the venturi 100 so as to pivot about a vertical axis 104. The steering nozzle 102 could also be supported at the exit of the tunnel 94 in other ways without a direct connection to the venturi 100. Moreover, the steering nozzle 102 can be replaced by a rudder or other diverting mechanism disposed at the exit of the tunnel 94 to selectively direct the thrust generated by the jet propulsion system 84 to effect turning.

Figure 8:
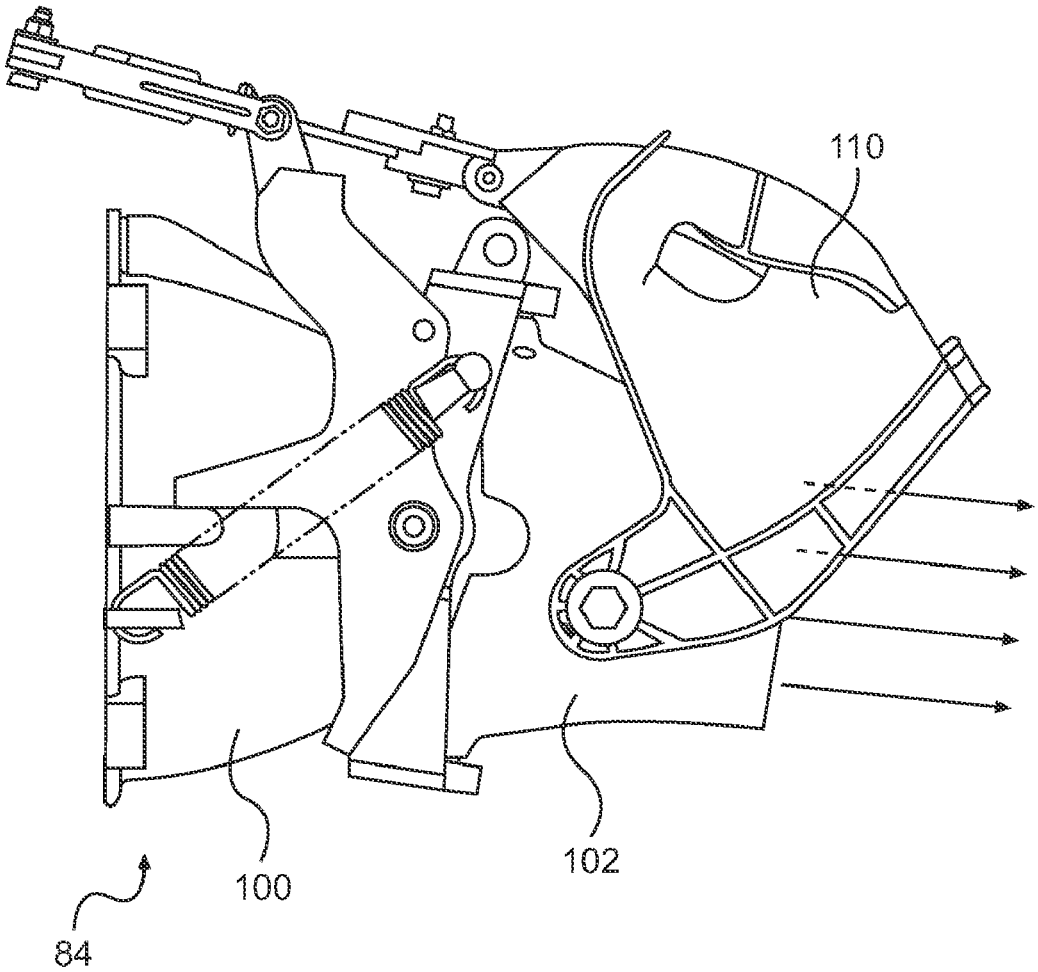
FIG. 8 is a side view of a jet propulsion system nozzle and reverse gate assembly where the reverse gate is mounted on the nozzle assembly with the reverse gate in a stowed position.
Figure 9:
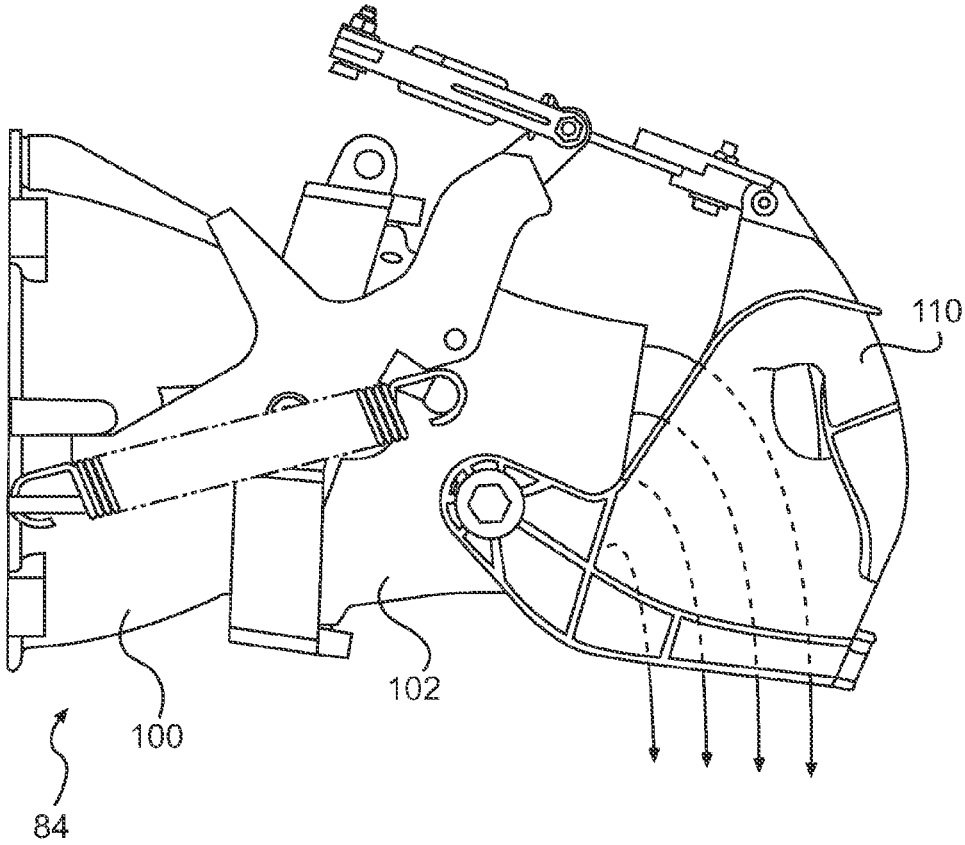
FIG. 9 is a side view of the jet propulsion system nozzle and reverse gate assembly of FIG. 8 with the reverse gate in a neutral position.

The steering nozzle 102 is operatively connected to the helm assembly 60 preferably via a push-pull cable (not shown) such that when the helm assembly 60 is turned, the steering nozzle 102 pivots. This movement redirects the pressurized water coming from the venturi 100, so as to redirect the thrust and steer the watercraft 10 in the desired direction. Optionally, the steering nozzle 102 may be gimbaled to allow it to move around a second horizontal pivot axis (as shown in FIGS. 8 and 9). The up and down movement of the steering nozzle 102 provided by this additional pivot axis is known as trim and controls the pitch of the watercraft 10.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 also turns faster. An electronic control unit (ECU) 200 (FIG. 12) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 10:
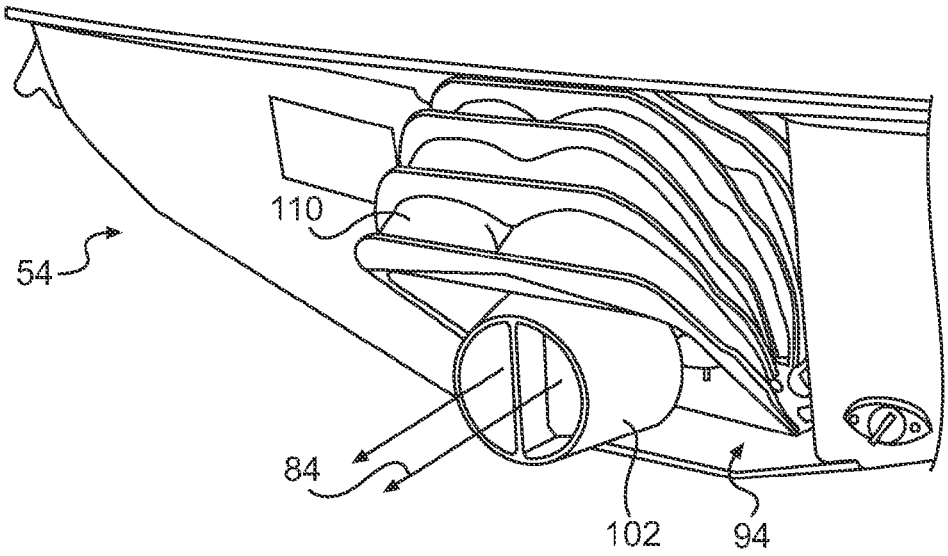
FIG. 10 is a perspective view, taken from a right side, of a transom of a watercraft illustrating a reverse gate mounted to the hull and in a stowed position.
Figure 11:
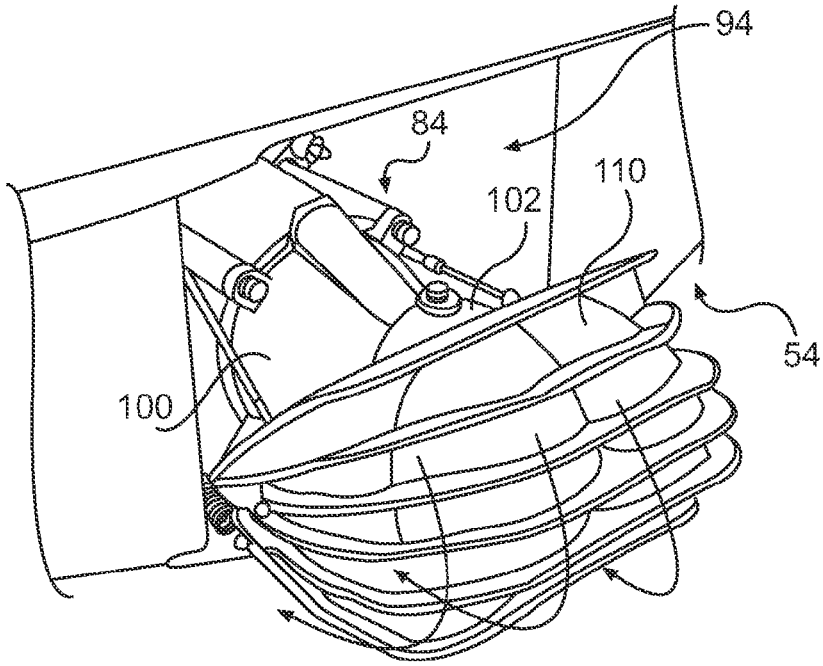
FIG. 11 is a perspective view, taken from a left side, of the transom of FIG. 10 with the reverse gate in a reverse position.

The watercraft 10 is provided with a reverse gate 110 which is movable between a first stowed position where it does not interfere with the jet of water (indicated by arrows 85) being expelled by the jet propulsion system 84 and a plurality of positions where it redirects the jet of water 85 being expelled by the jet propulsion system 84. As seen in FIGS. 8 and 9, it is contemplated that the reverse gate 110 could be mounted directly on the jet propulsion system 84 so as to move with the steering nozzle 102 as it turns and trims. Details of this arrangement can be found in U.S. Pat. No. 6,533,623 B2, issued Mar. 18, 2003, the entirety of which is incorporated herein by reference. In FIG. 8, the reverse gate 110 is in a stowed position. In FIG. 9, the reverse gate 110 is in a neutral position where it redirects the jet of water 85 downwardly. Since the thrust generated by the redirected jet of water 85 when the reverse gate 110 is in the neutral position does not have a horizontal component, the watercraft 10 will not be accelerated or decelerated by the thrust and will stay in position if it was not moving prior to moving the reverse gate 110 in the neutral position. As seen in FIGS. 10 and 11, it is also contemplated that the reverse gate 110 could be pivotally attached to the sidewalls of the tunnel 94. In FIG. 10, the reverse gate 110 is in a stowed position. In FIG. 11, the reverse gate 110 is in a reverse position as it redirects the jet of water 85 towards the front of the watercraft 10, thus causing the watercraft 10 to move in a reverse direction. Other ways of operatively mounting the reverse gate 110 to the hull 12 are also contemplated. The operation of the reverse gate 110 is discussed in greater detail below.

Figure 6:
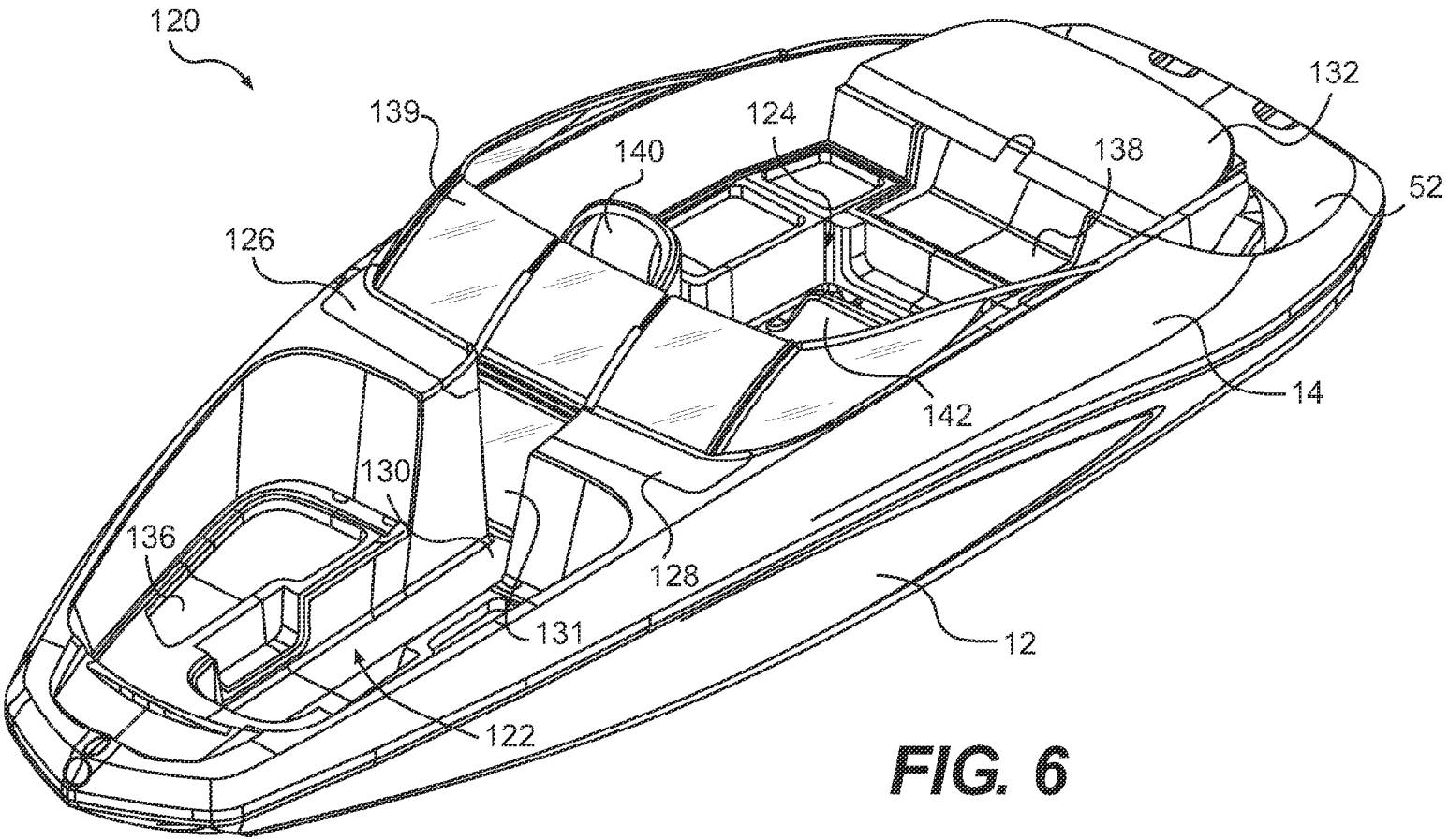
FIG. 6 is a perspective view, taken from a front, left side, of a jet boat in accordance with the invention.
Figure 7:
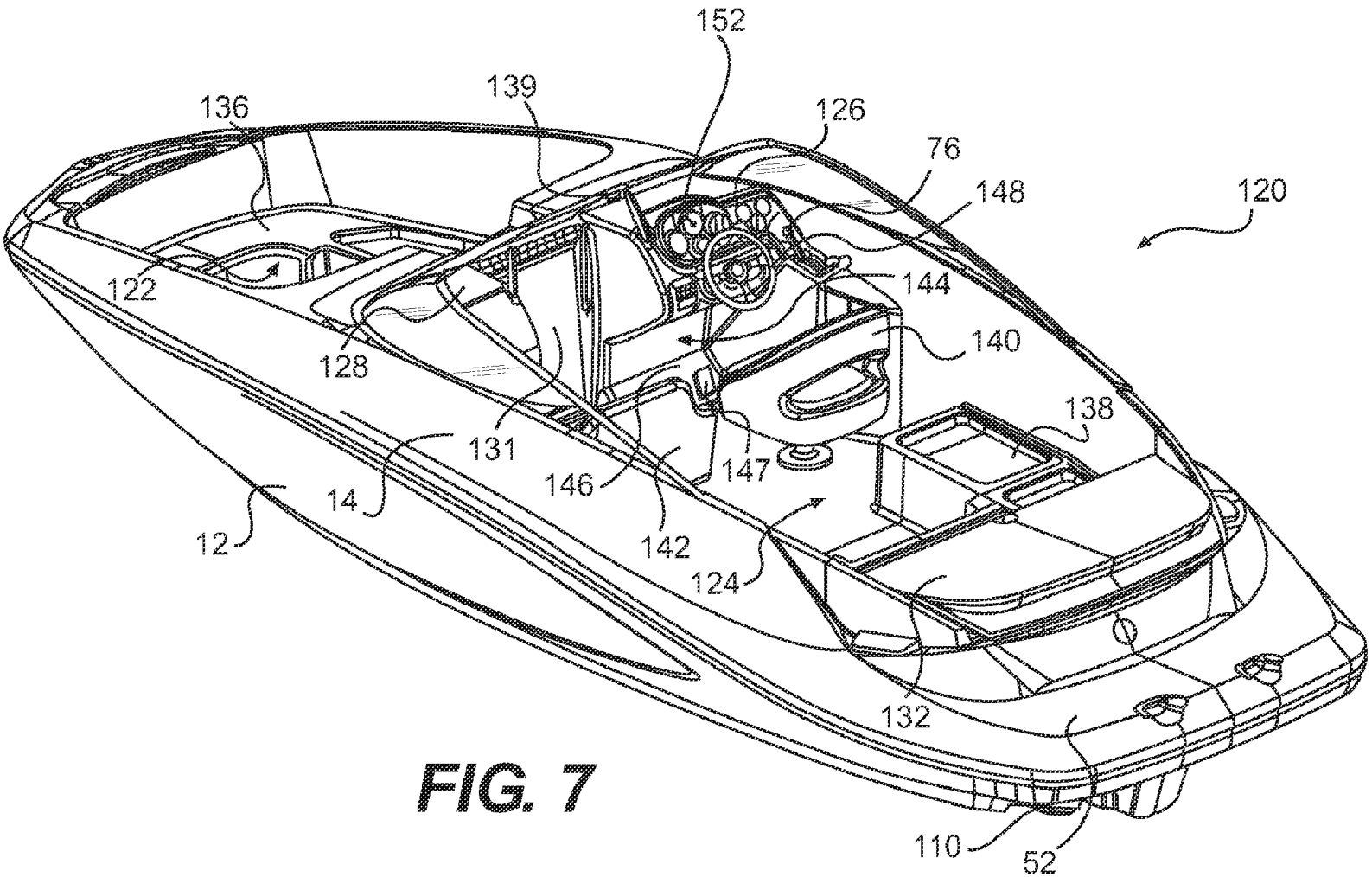
FIG. 7 is a perspective view, taken from a rear, left side, of the jet boat of FIG. 6.

The general construction of a jet boat 120 in accordance with this invention is shown in FIGS. 6 and 7. The following description relates to one way of manufacturing a jet boat. Obviously, those of ordinary skill in the jet boat art will recognize that there are other known ways of manufacturing and designing jet boats and that this invention would encompass these other known ways and designs.

For simplicity, the components of the jet boat 120 which are similar in nature to the components of the personal watercraft 10 described above will be given the same reference numeral. It should be understood that their specific construction may vary however.

The jet boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one engine (not shown) is located between the hull 12 and the deck 14 at the back of the boat 120. The engine powers the jet propulsion system (not shown) of the boat 120. The jet propulsion system is of similar construction as the jet propulsion system 84 of the personal watercraft 10 described above, and will therefore not be described again. A reverse gate 110 is operatively mounted to the hull 12. The reverse gate 110 is of similar construction as the reverse gate 110 of the personal watercraft 10 described above, and will therefore not be described again. In a preferred embodiment, the boat 120 has two engines and two jet propulsion systems each provided with a reverse gate 110. The engine is accessible through an engine cover 132 located behind the rearward passenger area 124. The engine cover 132 can also be used as a sundeck for a passenger of the boat 120 to sunbathe on while the boat 120 is not in operation. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A foot pedal 147 is provided on the footrest 146. The function of the foot pedal 147 is described in greater detail below. The left console 128 has a similar recess (not shown) to accommodate the feet of the passenger sitting in the passenger seat 142. The right console 126 accommodates all of the elements necessary to the driver to operate the boat. These include, but are not limited to, a helm assembly in the form of a steering wheel 148, a throttle operator 76 in the form of a throttle lever, and an instrument panel 152. The instrument panel 152 have various dials indicating the watercraft speed, engine speed, fuel and oil level, and engine temperature. The speed of the boat 120 is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Figure 12:
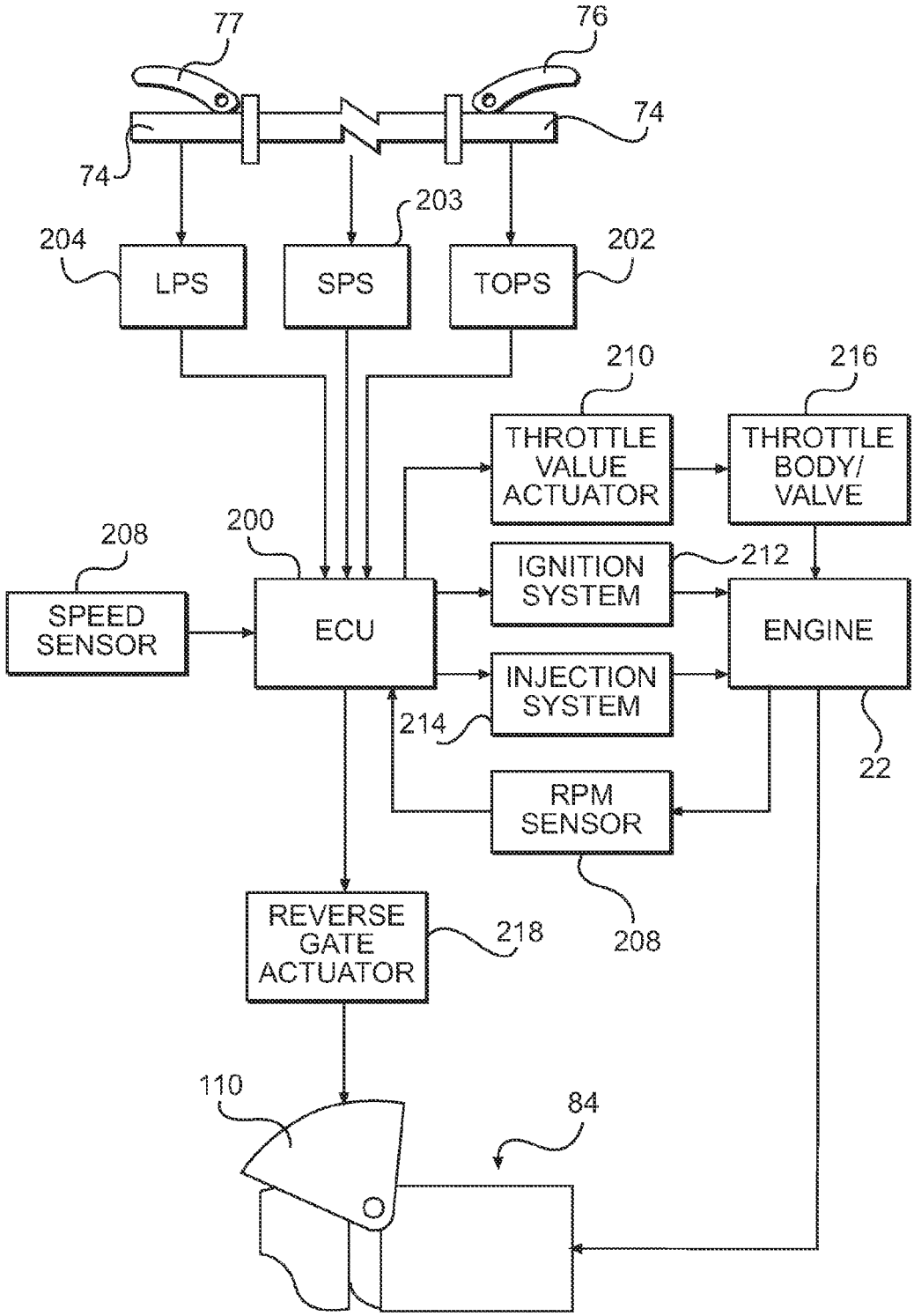
FIG. 12 is a schematic representation of the various sensors and watercraft components present in a watercraft in accordance with the present invention.

Turning now to FIG. 12, additional components of both the personal watercraft 10 and the jet boat 120 will be described. Although FIG. 12 illustrates a throttle operator 76 mounted to the handlebar like in the watercraft 10, it should be understood that a throttle operator 76 of the type used in the jet boat 120 is contemplated. Similarly, although the lever 77 is illustrated as being mounted to the handlebar, it is contemplated that a foot pedal, such as the foot pedal 147 of the jet boat 120, which can be considered as a foot actuated lever, could be used. In the personal watercraft 10, the foot pedal would be located in one of the footrests 46.

A throttle operator position sensor 202 senses a position of the throttle operator 76 and sends a signal representative of the throttle operator position to the ECU 200. Depending on the type of throttle operator 76, the throttle operator position sensor 202 is generally disposed in proximity to the throttle operator 76 and senses the movement of the throttle operator 76 or the linear displacement of a cable connected to the throttle operator 76. The throttle operator position sensor 202 is preferably in the form of a magnetic position sensor. In this type of sensor, a magnet is mounted to the throttle operator 76 and a sensor chip is fixedly mounted in proximity to the magnet. As the magnet moves, due to movement of the throttle operator 76, the magnetic field sensed by the sensor chip varies. The sensor chip transmits a voltage corresponding to the sensed magnetic field, which corresponds to the position of the throttle operator 76, to the ECU 200. It is contemplated that the sensor chip could be the one mounted to the throttle operator 76 and that the magnet could be fixedly mounted in proximity to the sensor chip. The throttle operator position sensor 202 could also be in the form of a rheostat. A rheostat is a resistor which regulates current by means of variable resistance. In this case, the position of the throttle operator 76 would determine the resistance in the rheostat which would result in a specific current being transmitted to the ECU 200. Therefore, this current is representative of the position of the throttle operator 76. It is contemplated that other types of sensors could be used as the throttle operator position sensor 202, such as a potentiometer which regulates voltage instead of current. It is also contemplated that the throttle operator position sensor 202 could be in the form of a switch which would be in one of an "on" and an "off" position when the throttle operator 76 is in the idle position and would be in the other of the "on" and the "off" position when the throttle operator 76 is in any position other than the idle position (i.e. an actuated position).

Similarly, a lever position sensor 204 senses a position of the lever 74 and sends a signal representative of the lever position to the ECU 200. The lever position sensor 204 can be of any of the types of sensors described above with respect to the throttle operator positions sensor 202.

A steering position sensor 203 senses an angle by which the helm assembly is turned and sends a signal representative of that angle to the ECU 200. The steering position sensor 203 can be of any type. Examples of such sensors are described in U.S. Pat. No. 6,428,371, issued Aug. 6, 2002, the entirety of which is incorporated herein by reference.

An engine speed sensor 206 senses a speed of rotation of the engine 22 and sends a signal representative of the speed of rotation of the engine 22 to the ECU 200. Typically, an engine, such has engine 22, has a toothed wheel disposed on and rotating with a shaft of the engine 22, such as the crankshaft or output shaft. The engine speed sensor 206 is located in proximity to the toothed wheel and sends a signal to the ECU 200 each time a tooth passes in front it. The ECU 200 can then determine the engine rotation speed by calculating the time elapsed between each signal. The speed of rotation of the engine 22 can be used by the ECU 200 to calculate the engine torque.

A watercraft speed sensor 208 senses the speed of the watercraft and sends a signal representative of the speed of the watercraft to the ECU 200. The ECU 200 sends a signal to a speed gauge located in the display cluster 78 (FIG. 2) of the personal watercraft 10 or in the instrument panel 152 of the jet boat 120 such that the speed gauge displays the watercraft speed to the driver of the watercraft. The vehicle speed sensor 208 can be of any type, such as the speed sensor 106 or the GPS unit described above.

Based on at least the signal received from the throttle operator position sensor 202, the ECU 200 controls the operation of the engine 22. One or more of the signals received from the lever position sensor 204, the steering position sensor 203, the engine speed sensor 206, and the watercraft speed sensor 208 can also be used by the ECU 200 to control the operation of the engine 22. The ECU 200 controls the operation of the engine 22, and therefore the speed of rotation of the engine 22, by sending signals to a throttle valve actuator 210, an ignition system 212 of the engine 22, and an injection system 214 of the engine 22. The throttle valve actuator 210 is preferably an electric motor, such as a servo motor. The throttle valve actuator 210 is connected to the valve of the throttle body 216 of the engine 22. Based on the signal from the ECU 200, the throttle valve actuator 210 changes a degree of opening of the throttle valve so as to control the flow of air to the engine 22. A throttle valve position sensor (not shown) could be provided to send a feedback signal indicative of the position of the throttle valve to the ECU 200. The signal from the ECU 200 to the ignition system 212 controls the ignition timing. The signal(s) from the ECU 200 to the injection system 214 controls the injection timing and the quantity of fuel being injected per injection event. It is contemplated that the engine 22 may be provided with a carburetor instead of the throttle body 216 and would therefore not require an injection system 214. It is believed that the way in which the degree of opening of the throttle valve, the ignition timing, the injection timing, and the quantity of fuel being injected affect the speed of rotation of the engine 22 are well understood by those skilled in the art of engines and will therefore not be described.

It is contemplated that the throttle operator 76 could be mechanically connected to the throttle valve, by a push-pull cable for example, in which case the throttle valve actuator 210 could be omitted. In this case, the ECU 200 would send signals to the ignition system 212 and injection system 214 based on the signals from at least one of the engine speed sensor 206 and the throttle valve position sensor described above.

The ECU 200 also sends a signal to a reverse gate actuator 218 to move the reverse gate 110 between a stowed position (FIGS. 8 and 10) and a position in which the reverse gate 110 redirects the jet of water 85 expelled from the jet propulsion system 84 (FIGS. 9 and 11), as will be described in greater detail below. The reverse gate actuator 218 can be in the form of an electric actuator, an hydraulic actuator, or any other type of actuator suitable for moving the reverse gate 110 and maintaining it in position.

In a first aspect, when the driver of the watercraft moves the throttle operator 76 to an idle position, the throttle operator position sensor 202 sends a signal indicative of that position to the ECU 200. The driver can move the throttle operator 76 by actively moving it from an actuated position to the idle position, as would be the case in the jet boat 120, or by simply releasing the throttle operator 76, as would be the case in of the personal watercraft 10 which has a throttle operator 76 which is biased towards the idle position. Once it receives the signal indicative of the idle position of the throttle operator 76, the ECU 200 sends a signal to the throttle valve actuator 210 and/or the ignition system 212 and/or the injection system 214 to control the speed of rotation of the engine 22 such that it is at or below a predetermined speed (i.e. if the engine speed is already below the predetermined speed, no action is necessary). For purposes of this application, this predetermined speed will be referred to as the reverse gate actuation speed. The reverse gate actuation speed is a speed of the engine above which the thrust generated by the jet propulsion system would be too high to lower the reverse gate 110 (i.e. attempting to do so would make it go back to the stowed position due to the thrust or the handling of the watercraft could be compromised), or would make such the lowering of the reverse gate 110. The reverse gate actuation speed will vary from one type of watercraft to the other as it is dependent on the features of the jet propulsion system (dimensions, impeller and stator shape and size) as well as the geometry and size of the reverse gate 110. Also, once it receives the signal indicative of the idle position of the throttle operator 76, the ECU 200 sends a signal to the reverse gate actuator 218 to move the reverse gate to a neutral position after the engine speed is at or below the reverse gate actuation speed. This occurs without any further driver intervention. The driver simply has to move the throttle operator 76 to the idle position for the reverse gate 110 to be moved to the neutral position.

In a first embodiment, the neutral position is a predetermined position where the reverse gate 110 redirects the jet of water 85 expelled from the jet propulsion system 84 downwardly, as shown in FIG. 9, such that the thrust generated by the redirected jet of water 85 has no horizontal components. Therefore, a watercraft which is at rest when the throttle operator 76 is in the idle position will remain in position.

In a second, embodiment the ECU 200 uses the signal from the watercraft speed sensor 208 in addition to the signal from the throttle operator position sensor 202 to determine the position of the reverse gate 110 when the throttle operator 76 is in the idle position. By using the watercraft speed sensor 208, the ECU 200 will send a signal to the reverse gate actuator 218 to move the reverse gate 110 to a "neutral" position which has a rearward thrust component if the watercraft is moving forwardly and which has a forward thrust component if the watercraft is moving rearwardly such that the watercraft speed becomes or remains near or at zero. It is contemplated that the ECU 200 could send signals to the throttle valve actuator 210, the ignition system 212, and the injection system 214 to adjust the speed of rotation of the engine 22 in order to control the amount of thrust generated. The type of speed sensor 208 used will affect the result on the movement (or lack thereof) of the watercraft in the second embodiment. If the speed sensor 208 measures the speed of the watercraft relative to the water in which it is, as would be the case with the speed sensor 106 using the paddle wheel 108, then the neutral position will be determined such that the watercraft remains in position relative to the water, which means that if there is a water current, the watercraft will move together with the current. If the speed sensor 208 measures the absolute speed of the watercraft (i.e. relative to a stationary object), as would be the case with a GPS unit, then the neutral position will be determined and constantly adjusted such that the watercraft remains in position regardless of water currents. It is contemplated that the reverse gate 110 could be moved to the neutral position described above only after the speed of rotation of the engine 22 or the speed of watercraft is below a predetermined threshold.

When the driver moves the throttle operator 76 from the idle position to an actuated position, the signal received from the throttle operator position sensor 202 by the ECU 200 causes the ECU 200 to send a signal to the reverse gate actuator 218 to move the reverse gate 110 to the stowed position (FIGS. 8 and 10). This occurs without any further driver intervention. The driver simply has to move the throttle operator 76 to an actuated position for the reverse gate 110 to be moved to the stowed position.

In a second aspect, when the driver of the watercraft actuates the lever 77, the lever position sensor 204 sends a signal indicative of that position to the ECU 200. Once it receives the signal indicative of the actuation of the lever 77, the ECU 200 sends a signal to the throttle valve actuator 210 and/or the ignition system 212 and/or the injection system 214 to control the speed of rotation of the engine 22 such that it is at or below the reverse gate actuation speed described above. The ECU 200 also sends a signal to the reverse gate actuator 218 to move the reverse gate to a position in which the reverse gate 110 redirects the jet of water 85 being expelled from the jet propulsion system 84 at least in part towards the front of the watercraft, as shown in FIG. 11, once the engine speed is at or below the reverse gate actuation speed. Also, upon receiving the signal indicative of the actuation of the lever 77, and once the reverse gate actuator 218 has moved the reverse gate 110 to the position in which the reverse gate 110 redirects the jet of water 85, the ECU 200 sends a signal to the throttle valve actuator 210 and/or the ignition system 212 and/or the injection system 214 to control the speed of rotation of the engine 22 such that the thrust generated by the redirected water jet 85 will result in a controlled deceleration of the watercraft, which may include increasing the engine speed above the reverse gate actuation speed. The speed of rotation of the engine 22 is adjusted throughout the controlled deceleration. It is contemplated that the speed of rotation of the engine 22 could be controlled so as to provide thrust in bursts. It is contemplated that the position of the reverse gate 110 could be also be adjusted throughout the controlled deceleration. This occurs without any further driver intervention. The driver simply has to move the lever 77 to an actuated position for the controlled deceleration to be initiated.

It is contemplated that the ECU 200 could use the signal obtained from the watercraft speed sensor 208 to control the speed of rotation of the engine 22 so as to obtain a controlled deceleration. Alternatively, it is contemplated that an accelerometer (not shown) could be used instead of or in addition to the watercraft speed sensor 208 to provide a signal to the ECU200 to control the speed of rotation of the engine 22 so as to obtain a controlled deceleration.

In a preferred embodiment, the degree and/or the rate of deceleration during the controlled deceleration is proportional to the degree of actuation of the lever 77.

It is contemplated that in watercraft where the ECU 200 receives a signal indicative of the position of the throttle operator 76, as in FIG. 12, the ECU 200 sends a signal to the throttle valve actuator 210 to adjust a position of the throttle valve based on the sensed position of the throttle operator 76 when the lever 77 is not actuated, and will ignore the signal from the throttle operator position sensor 202 when the lever 77 is actuated and will instead generate a signal to control the position of the throttle valve such that a controlled deceleration of the watercraft is obtained as described above.

It is also contemplated that when the watercraft speed sensed by the speed sensor 208 is at or near zero that the ECU 200 would send a signal to the reverse gate actuator 218 to move the reverse gate 110 to the neutral position described above.

In another aspect, when the driver of the watercraft turns the helm assembly beyond a predetermined angle, the steering position sensor 203 sends a signal indicative of that angle to the ECU 200. Once it receives the signal indicative of the steering angle, the ECU 200 determines if the engine speed is below a steering assist speed. The steering assist speed is an engine speed below which steering of the watercraft would be difficult due to the lack of thrust. Depending on the watercraft, the steering assist speed may be higher or lower than the reverse gate actuation speed. If the helm assembly is turned beyond the predetermined angle and the engine speed is below the steering assist speed, the ECU 200 sends a signal to the throttle valve actuator 210 and/or the ignition system 212 and/or the injection system 214 to control the speed of rotation of the engine 22 such that it is at or below the reverse gate actuation speed described above. The ECU 200 also sends a signal to the reverse gate actuator 218 to move the reverse gate to a position in which the reverse gate 110 redirects the jet of water 85 being expelled from the jet propulsion system 84 at least in part towards the front of the watercraft, as shown in FIG. 11, once the engine speed is at or below the reverse gate actuation speed. Once the reverse gate actuator 218 has moved the reverse gate 110 to the position in which the reverse gate 110 redirects the jet of water 85, the ECU 200 sends a signal to the throttle valve actuator 210 and/or the ignition system 212 and/or the injection system 214 to control the speed of rotation of the engine 22 such that the thrust generated by the redirected water jet 85 will result in a controlled deceleration of the watercraft, which may include increasing the engine speed above the reverse gate actuation speed. The speed of rotation of the engine 22 is adjusted throughout the controlled deceleration. It is contemplated that the speed of rotation of the engine 22 could be controlled so as to provide thrust in bursts. It is contemplated that the position of the reverse gate 110 could be also be adjusted throughout the controlled deceleration. This occurs without any further driver intervention.

Figure 13C:
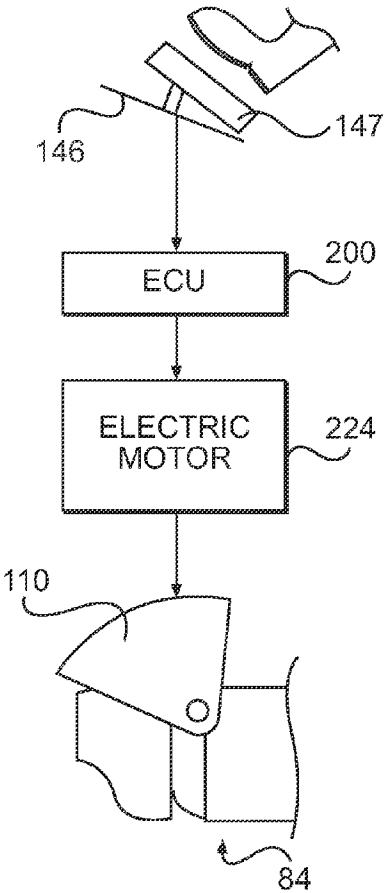
FIG. 13C is a schematic representation of another alternative embodiment of the watercraft components of FIG. 13A.
Figure 13B:
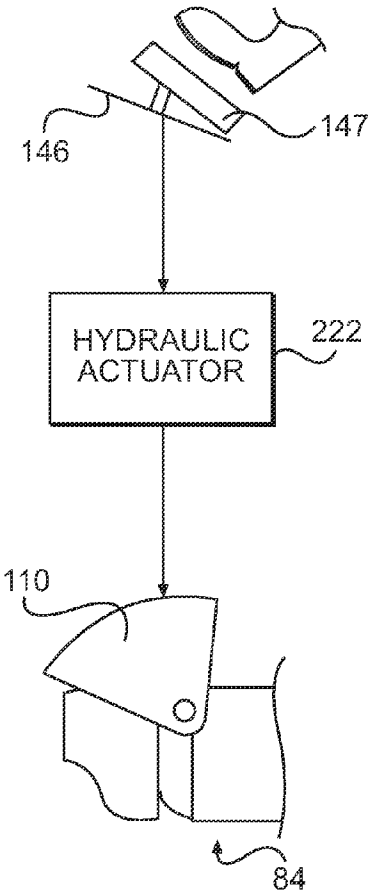
FIG. 13B is a schematic representation of an alternative embodiment of the watercraft components of FIG. 13A.
Figure 13A:
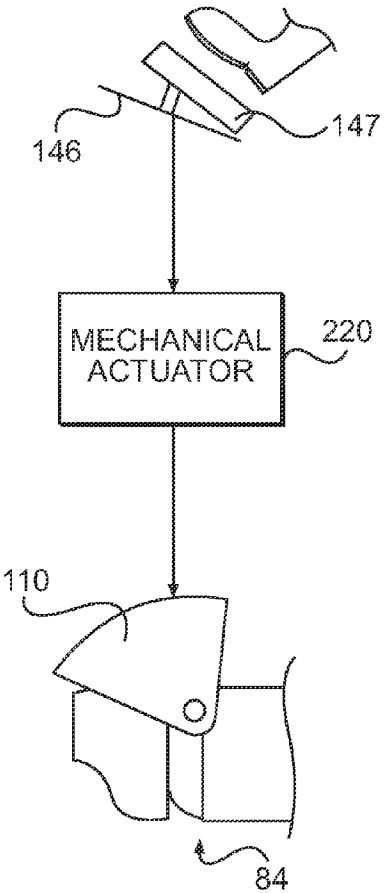
FIG. 13A is a schematic representation of a first embodiment of the watercraft components present in a watercraft in accordance with other objects of the present invention.

Turning now to FIGS. 13A to 13C, another aspect of the invention will be described. As previously described, the jet boat 120 is provided with a foot pedal 147 and, as previously mentioned, the personal watercraft 10 could also be provided with a similar foot pedal disposed in one of the footrests 46. As shown in FIGS. 13A to 13C, the foot pedal 147 is operatively connected to the reverse gate 110. When the foot pedal 147 is not actuated, the reverse gate 110 is in the stowed position. When the foot pedal 147 is actuated, the reverse gate 110 moves to a position in which the jet of water 85 expelled by the jet propulsion system 84 is redirected. In a preferred embodiment, the position of the reverse gate 110 is proportional to the degree of actuation of the foot pedal 147. FIG. 13A illustrates an embodiment where the foot pedal 147 is operatively connected to the reverse gate 110 via a mechanical actuator 220. FIG. 13B illustrates an embodiment where the foot pedal 147 is operatively connected to the reverse gate 110 via a hydraulic actuator 222. FIG. 13C illustrates a preferred embodiment where the ECU 200 first receives a signal indicative of the position of the foot pedal 147. The ECU 200 then sends a signal to an electric motor 224 to move the reverse gate 110 to a position based on the signal indicative of the position of the foot pedal 147.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A method of controlling a watercraft, the watercraft having a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a lever, and a reverse gate operatively connected to the hull, the reverse gate being movable between a first stowed position and a second position in which the reverse gate redirects a jet of water expelled from the jet propulsion system, the reverse gate being in operative connection with the lever, the method comprising:

actuating the lever;

determining a speed of rotation of the engine;

if the speed of rotation of the engine is above a predetermined reverse gate actuation speed:

controlling the speed of rotation of the engine to be at or below the reverse gate actuation speed in response to the actuation of the lever; and moving the reverse gate to the second position in response to the actuation of the lever without further driver intervention once the speed of rotation of the engine is at or below the reverse gate actuation speed;

if the speed of rotation of the engine is at or below the predetermined reverse gate actuation speed:

moving the reverse gate to the second position in response to the actuation of the lever without further driver intervention; and controlling the speed of rotation of the engine in order to decelerate the watercraft in response to the actuation of the lever and the reverse gate moving to the second position without further driver intervention.

2. The method of claim 1, wherein controlling a speed of rotation of the engine in order to decelerate the watercraft includes increasing the speed of rotation of the engine above the reverse gate actuation speed.

3. The method of claim 1, further comprising adjusting the second position of the reverse gate without further driver intervention.

4. The method of claim 1, wherein controlling the speed of rotation of the engine comprises adjusting a position of a throttle valve of the engine.

5. The method of claim 1, wherein controlling the speed of rotation of the engine comprises adjusting at least one of an ignition timing and an injection timing of the engine.

6. The method of claim 1, further comprising:

sensing a position of the throttle operator;

adjusting a position of a throttle valve of the engine based on the position of the throttle operator when the lever is not actuated;

generating a signal when the lever is actuated; and adjusting the position of the throttle valve of the engine based on the signal when the lever is actuated.

7. The method of claim 1, further comprising:

sensing a speed of the watercraft; and moving the reverse gate to a neutral position in which the reverse gate redirects a jet of water expelled from the jet propulsion system so as to maintain the watercraft in position when the speed of the watercraft is near or at zero without further driver intervention.

8. A watercraft comprising:

a hull;

a deck disposed on the hull;

an engine compartment defined between the hull and the deck;

an engine disposed in the engine compartment;

a throttle body having a throttle valve and being in fluid communication with the engine;

a jet propulsion system connected to the hull and operatively connected to the engine;

an electronic control unit (ECU) associated with the watercraft for controlling at least an operation of the engine;

a throttle operator being movable between an idle position and an actuated position and being in electronic communication with the ECU;

a throttle valve actuator operatively connected to the throttle valve and in electronic communication with the ECU;

an engine speed sensor for sensing a rotational speed of the engine and being in electronic communication with the ECU;

a reverse gate operatively connected to the hull, the reverse gate being movable between a first stowed position and a second position in which the reverse gate redirects a jet of water expelled from the jet propulsion system;

a reverse gate actuator operatively connected to the reverse gate for moving the reverse gate between the first stowed position and the second position, and being in electronic communication with the ECU; and a lever associated with the watercraft and being in electronic communication with the ECU, wherein when the engine speed sensor senses a speed of rotation of the engine above a predetermined reverse gate actuation speed, the ECU sends a first signal to the throttle valve actuator in response to an actuation of the lever such that a speed of rotation of the engine is controlled to be at or below the reverse gate actuation speed, the ECU sends a second signal to the reverse gate actuator to move the reverse gate to the second position in response to the actuation of the lever once the speed of rotation of the engine is at or below the reverse gate actuation speed;

wherein when the engine speed sensor senses a speed of rotation of the engine at or below the predetermined reverse gate actuation speed, the ECU sends the second signal to the reverse gate actuator to move the reverse gate to the second position in response to the actuation of the lever; and wherein the ECU sends a third signal to the throttle valve actuator in response to the actuation of the lever such that actuating the lever results in a controlled deceleration of the watercraft once the reverse gate is in the second position.

9. The watercraft of claim 8, further comprising a handlebar;

wherein the throttle operator is disposed on the handlebar; and wherein the throttle operator is selected from a group consisting of a thumb-actuated throttle lever, a finger-actuated throttle lever, and a twist grip.

10. The watercraft of claim 8, wherein the reverse gate actuator is an electric actuator.

11. The watercraft of claim 8, wherein the reverse gate actuator is a hydraulic actuator.

12. The watercraft of claim 8, wherein the controlled deceleration is proportional to a degree of actuation of the lever.

13. The watercraft of claim 8, further comprising a watercraft speed sensor for sensing the speed of the watercraft and being in electronic communication with the ECU.

14. A method of controlling a watercraft, the watercraft having a hull, a deck disposed on the hull, a seat disposed on the deck, a helm assembly disposed on the deck, an engine compartment defined between the hull and the deck, an engine disposed in the engine compartment, an electronic control unit, a jet propulsion system connected to the hull and operatively connected to the engine, a throttle operator for controlling the engine, and a reverse gate operatively connected to the hull, the reverse gate being movable between a first stowed position and a second position in which the reverse gate redirects a jet of water expelled from the jet propulsion system, the reverse gate being in operative connection with the lever, the method comprising:

turning the helm assembly beyond a predetermined angle;

determining if a speed of rotation of the engine is below a steering assist speed;

controlling the speed of rotation of the engine to be at or below a predetermined reverse gate actuation speed in response to the helm assembly being turned beyond the predetermined angle and the speed of rotation of the engine being below the steering assist speed;

moving the reverse gate to the second position in response to the helm assembly being turned beyond the predetermined angle without further driver intervention once the speed of rotation of the engine is at or below the reverse gate actuation speed; and controlling the speed of rotation of the engine in order to decelerate the watercraft in response to the helm assembly being turned beyond the predetermined angle and the reverse gate moving to the second position without further driver intervention.

15. The method of claim 14, wherein controlling a speed of rotation of the engine in order to decelerate the watercraft includes increasing the speed of rotation of the engine above the reverse gate actuation speed.

16. The method of claim 14, wherein controlling the speed of rotation of the engine comprises adjusting a position of a throttle valve of the engine.

17. The method of claim 14, wherein controlling the speed of rotation of the engine comprises adjusting at least one of an ignition timing and an injection timing of the engine.

* * * * *